United States Patent [19]

Bengoa

[11] 4,024,411

[45] May 17, 1977

[54] APPARATUS FOR CONSERVING ELECTRICAL ENERGY

[76] Inventor: Jose' E. Bengoa, P. O. Box 9943, Santurce, P.R. 00908

[22] Filed: Nov. 24, 1975

[21] Appl. No.: 634,645

[52] U.S. Cl. ..... 307/41; 307/141.4; 340/309.1

[51] Int. Cl.[2] ..... H01H 7/00

[58] Field of Search ..... 307/41, 141, 141.4, 307/141.8, 38, 40; 235/151.21; 340/309.1

[56] References Cited

UNITED STATES PATENTS

| | | | |
|---|---|---|---|
| 3,497,710 | 2/1970 | Gorman et al. | 307/141.4 |
| 3,577,004 | 5/1971 | Tsoutsas | 307/141 |
| 3,712,987 | 1/1973 | McKeown | 307/41 |
| 3,787,728 | 12/1971 | Bayer et al. | 307/41 |

*Primary Examiner*—Herman J. Hohauser
*Attorney, Agent, or Firm*—Scrivener Parker Scrivener & Clarke

[57] ABSTRACT

Apparatus for providing a percentage time control for the manageable and controllable electrical loads in the home such as air conditioning units, hot water heaters, space heaters and like devices, such apparatus including a master timer or programmer which is connected with the said devices so as to automatically predetermine the time periods of operation thereof in a manner such that a considerable saving in the consumption of electrical energy may be effected by periodically deenergizing the units in a selective manner. The arrangement is also such that the automatic "On-Off" periods of operation of the controlled devices may be readily varied or even interrupted in order to be adaptable to different conditions encountered in the home.

3 Claims, 3 Drawing Figures

APPARATUS FOR CONSERVING ELECTRICAL ENERGY

DESCRIPTION OF THE INVENTION

The present invention is illustrated in the accompanying drawing and described in the following specification as comprising a time-controlled circuit arrangement for controlling the "On-Off" periods of operation of the various controllable electrical loads usually found in the home. For example, one or more room air conditioning units or even a central unit may be automatically controlled in such a manner that the motor-compressor units are deenergized for a longer time period than normally determined by the thermostatic controls associated with such units, thus conserving electrical energy. The same situation exists as to the hot water heater or the space heater, the saving of energy being achieved under the control of the master timer.

It is therefore the principal object of the present invention to provide a novel control circuit arrangement for predetermining the periods of energization of the manageable electrical loads in the home for the purpose of conserving energy.

Another object of the invention includes the provision of a master primary timer and two separate secondary timers, the master timer being so arranged as to program the entire control system and the secondary timers being arranged to separately program day and night operation of the loads.

A further object resides in the provision of separate manually operable control switches for each load so that any selected load may be removed from the automatic time controlled cycle and restored to its normal operation.

Other objects and novel features of the invention will appear more fully hereinafter from the following detailed description when taken in connection with the accompanying drawing wherein one embodiment of the invention is illustrated. It is to be expressly understood, however, that the drawings are utilized for purposes of illustration only and are not to be taken as a definition of the invention, reference being had for this purpose to the appended claims.

Referring to the drawings wherein similar reference characters denote similar parts throughout the several views.

Figure 1:
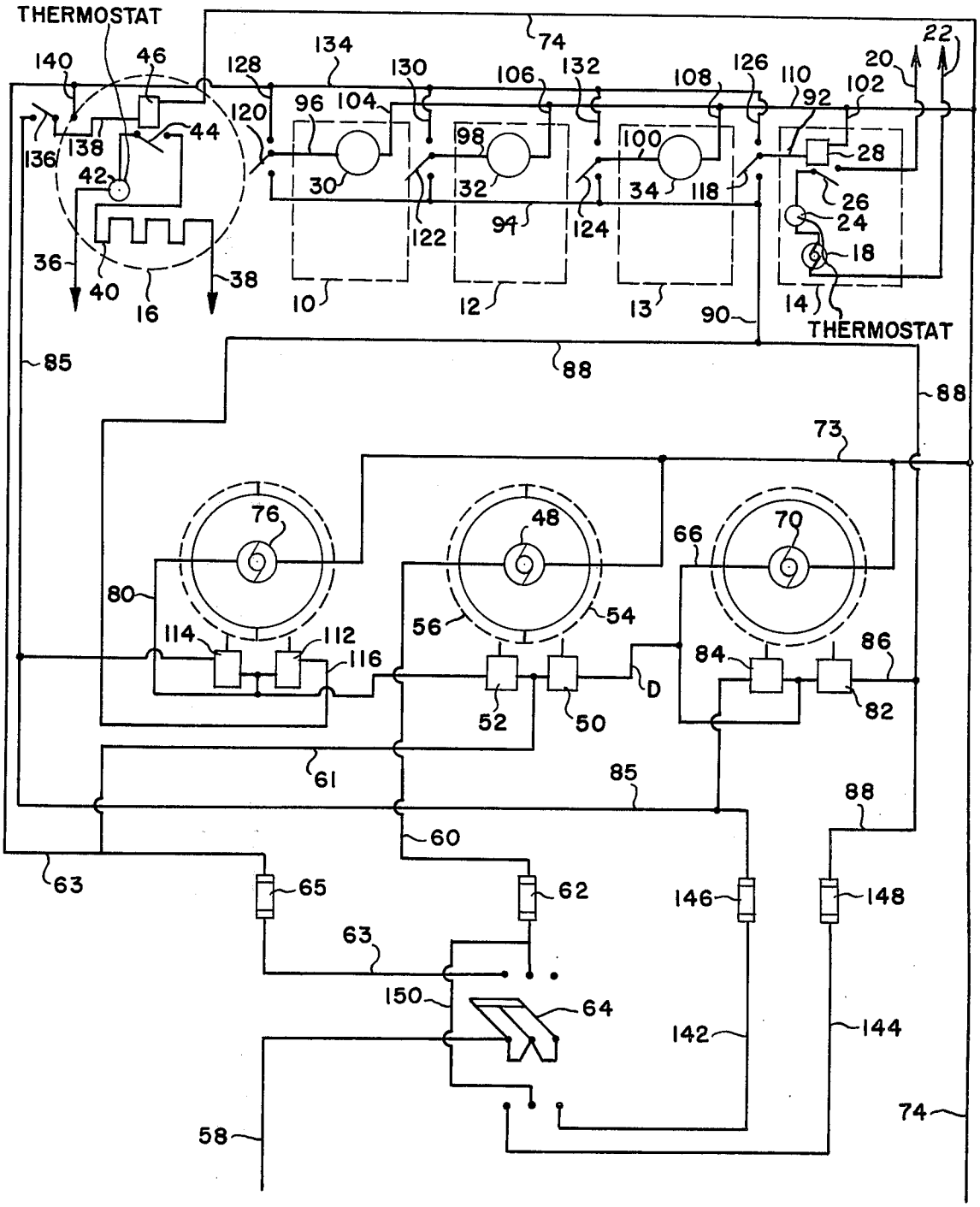
FIG. 1 is a diagrammatic circuit arrangement showing the present invention associated with a plurality of controllable electric loads.

Referring to FIG. 1, the invention is shown therein as being associated with a plurality of room air conditioning or cooler units 10, 12, 13 and 14 and one or more electrical water heater units 16, these units being of conventional construction usually found in the home and constituting manageable controllable electrical loads for which the invention is particularly suited for the purpose of automatically controlling the periods of "On-Off" operation thereof in order to conserve electrical energy. Each of the room cooling units 10, 12, 13 and 14 is controlled by its individual motor-compressor unit 18 which is connected in series with the house wiring conductors 20 and 22 through a conventional thermostat 24 and contacts 26 of a control relay 28.

These contacts are normally open, as shown, when the relay 28 is deenergized. For purposes of simplification, the circuit arrangement just described has been illustrated in connection with cooler unit 14 only, it being understood, however, that similar circuit connections including control relays 30, 32 and 34 similar to the relay 28 are associated with the coolers 10, 12, 13. In like manner, the water heater unit 16 is connected with the house wiring conductors 36 and 38, the heater being provided with the conventional water heating coil 40 which is arranged in series with thermostat 42 and normally open contacts 44 of a control relay 46. From the foregoing it is seen that with the contacts 44 of the heater unit 16 and the contacts 26 of the cooler units 10, 12, 13 and 14, normally open, none of these units will function in the usual manner under the control of the respective thermostats 42 and 24. However, operation of the units may be initiated by energizing the control relays 28 and 46 to close the associated contacts 26 and 44 and thus connect the units with the supply conductors 20, 22 and 36, 38.

Figure 2:
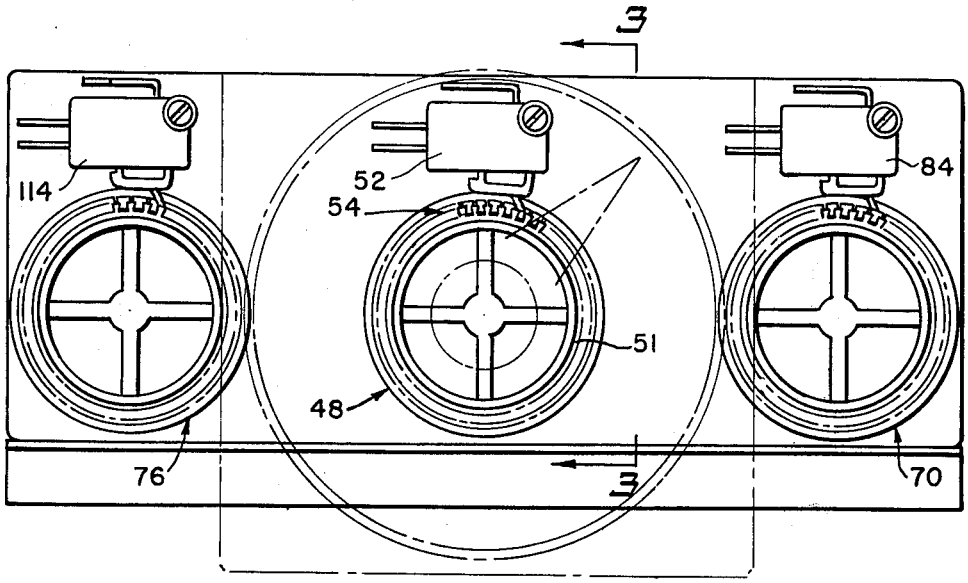
FIG. 2 is a front view of a plurality of timing devices which are utilized with the invention.

The present invention provides a novel control arrangement for automatically energizing the control relays 28, 30, 32, 34 and 46 in a programmed time-controlled sequence so that the "On-Off" operation of the electrical loads constituted by the water heater unit 16 and the room cooler units 10, 12, 13 and 14 may be readily predetermined. More particularly, and as shown in FIGS. 1 and 2 the invention includes a master timer or programmer 48 which is preferably of the rotatable drum type, and rotates one revolution per day, for example. The timer is provided with a series of axially arranged spaced-apart slots 49 formed in the drum 51 for the reception of actuators which are arranged to operate a microswitch 50 for controlling the load units 10, 12, 13, 14 and 16 during the day and to actuate a microswitch 52 for controlling the said units during the night. As shown, see FIGS. 2 and 3, the master timer 48 is provided with a pair of actuators 54, 56 for respectively controlling the microswitches, each actuator extending half-way around the circumference of the drum and being axially spaced-apart and so related to the microswitches 50 and 52 that the actuator 54 closes microswitch 50 for twelve hours during the day operation and actuator 56 will close the microswitch 52 for twelve hours during night operation, it being understood that the arrangement is such that when one microswitch is closed, the other is open and vice versa and that no overlapping occurs.

In order to energize the master timer 48, the motor thereof is connected to a supply conductor 58 through lead 60, fuse 62 and master switch 64, the latter being arranged to be moved from its central "OFF" position to an upper closed position for automatic time controlled operation of the heater and cooling units. With the switch 64 moved to its closed position as aforesaid, and assuming day time operation, closure of the microswitch 50 by the actuator 54 will connect leads 61 and 63 by way of fuse 65, conductor D and conductor 66 to the motor of a secondary timer 70 for day time operation, the circuit to the latter being completed by wires 72, 73 and supply conductor 74. In like manner, a secondary timer 76 for night operation is arranged to be energized by closure of the microswitch 52 during the night time when the actuator 56 is cooperatively related to the said switch. The motor of the night timer is then connected to the conductor 61 by way of lead 80 and is connected with the supply conductor 74 by the connection 73.

The secondary timers 70 and 76 are similar to the master timer 48 except that they may operate at 24 or 30 minutes per revolution, for example. In the case of a 24 minute revolution of day timer 70, actuator arranged in the slots of the timer drum may be such as to cycle the closing, and opening of a microswitch 82 to provide two continuously repeated zones which control the energization of the cooling units 10, 12, 13 and 14 for 9 minutes and the deenergization of such units for 3 minutes. The heater unit 16 is controlled by the closing and opening of a microswitch 84 through actuators arranged on the timer drum in such a manner as to energize the unit 16 by way of conductor 85 to provide two to four hours of day time operation. The periods of "On-Off" operation of the cooling units and the heater unit may be readily adjusted to suit changing conditions in the home such adjustments being made, for example, by changing the number of actuators carried by the slots in the drums of the secondary actuators 70 and 76. As shown, the microswitch 82 is connected to the control relays 28, 30, 32 and 34 of the cooling units 14, 10, 12, and 13 through conductors 86, 88, 90, 92, 94, 96, 98 and 100, the circuits through the respective relays and to the conductor 74 comprising connections 102, 104, 106, 108 and 110.

The night timer 76 may be similar to the day timer 70 in its cycling control of the cooling units and the heater unit. In such event the actuator arranged in the slots of the timer drum control the opening and closing of a microswitch 112, for cycling the periods of operation of the room coolers 10, 12, 13, and 14 as well as controlling the opening and closing of a microswitch 114 for controlling the water heater 16. The switch 112 is connected by wire 116 to the conductor 88 leading to the cooler units while the switch 114, when closed connects conductor 80 with the connection 85 leading to the water heating unit 16.

Figure 3:
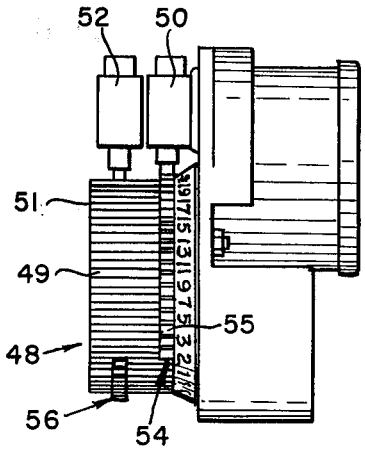
FIG. 3 is a side view of the master timing device of FIG. 2, looking in the direction of the arrows in FIG. 2.

Referring more particularly to FIGS. 2 and 3, each of the actuators 54 and 56 may comprise a plurality of small teeth 55 which are moved into position in the slots 49 and frictionally held in place to form the actuators, the exterior surfaces of the teeth being substantially continuous for sliding contact with the actuating arms of the microswitches 50 and 52. Referring to FIG. 3, the actuators 54 and 56 represent two zones of operation for the microswitches 50 and 52. The timers 70 and 76 are similar to the timer 48, as shown in FIG. 3 except for the speed of rotation and the arcuate extent of the actuators on the drums thereof for actuating the microswitches associated therewith. It will be understood that the actuators on the day and night timers are axially spaced apart and that the microswitches are positioned in axial alignment in a manner similar to that shown in FIG. 3.

As heretofore pointed out, the upper closed position of the switch 64 is the automatic position wherein the cooler units 10, 12, 13 and 14 as well as the heater unit 16 are controlled by the timing devices 48, 70 and 76 for the purpose of predetermining the "On-Off" periods of operation of the controllable units. Each of the relays 28, 30, 32 and 34 is connected to the common conductor 94 through respective manually operable control switches 118, 120, 122 and 124 for the purpose of disconnecting any particular room cooling unit at will and thus removing that unit from the automatic "On-Off" cycling operation. Each of the foregoing switches are of the single pole double throw type and when they occupy their lower positions the respective room coolers are under the automatic control of the timers 48, 70 and 76. When the switches 118, 120, 122 and 124 are moved to their upper positions, the relays 28, 30, 32 and 34 are respectively connected via connections 126, 128, 130 and 132 to the supply conductor 58 by way of conductors 134, 63 and the main switch 64. Hence, should it be desired to remove any particular cooling unit from the automatic cycling control of the timers 48, 70, and 76, it is only necessary to move the control switch associated with that unit to its upper position. In the case of the unit 14 for example, the switch 118, when so moved to its upper position would effect energization of the relay 28 through the connections just described in order to close the contact 26 and connect the motor compressor unit 24 with the energy supply. Thus, the unit 14 then functions in the normal manner under the control of its associated thermostat. All other cooling units having their control switches in the lower automatic position will remain under the direct control of the timers 48, 70 and 76. The heater unit 16 is also provided with a local control switch 136, which may be moved to its left automatic position, as viewed in FIG. 1, to connect relay 46 through connection 138 to the conductor 85 for automatic time controlled operation. In the event that automatic time controlled "On-Off" operation is no longer desired, the switch 136 is moved to its right hand position to connect the relay 46 to the line conductor 58 by way of wire 140, connection 63 and main switch 64. The heater unit will then function independently of the automatic time controlled operation and will be returned to conventional operation under the control of its local thermostat 42.

In the foregoing, it has been pointed out that one or more of the controllable units may be disconnected from the automatic time controlled devices and connected for conventional operation. Should it be desired to remove all of the units from the automatic control and return them to conventional operation, it is only necessary to move the main switch 64 to its lower position. Control switches 118, 120, 122 and 124 should remain in the lower, automatic positions and control switch 136 should remain in its left hand automatic position. Line conductor 58 will then be connected to the connections 85 and 88 by respective conductors 142 and 144 and fuses 146 and 148 so that the relays 46, 30, 32, 34 and 28 will close their associated contacts to energize the loads associated therewith in accordance with the local thermostats. Conductor 58 will also be connected with the master timer 48 through connections 150 and 60 so that operation of the timer will continue during manual operation. If desired, a 24 hour clock face, not shown, may be associated with the timer 48 and an hour hand connected with the timer to rotate therewith.

It is believed that the operation of the invention will be clear from the foregoing. In connection with the operation of the cooler units 10, 12, 14 and 16 it is pointed out that during the automatic timer-controlled operation thereof, the connections ae such that the associated motor compressors are controlled but the conventional circulating fans are allowed to continue their operation during periods when the automatic control deenergizes the motor compressors. This is accomplished, in the case of unit 14 for example, by connecting the contact 26 of the relay 28 in series with the thermostat 24. This feature enables the fan to keep recirculating, ambient air which is already well conditioned.

It will be clear from the above that the present invention provides a novel automatic time-controlled system for controlling the "On-Off" periods of operation of one or more electrical loads of the manageable and controllable type and the invention has been described in detail in connection with the control of air conditioning and water heater units. It will be understood that other types of units may be controlled such as swimming pool filtering systems, outdoor lighting arrangements and other systems which are sequence controlled. In such case, it is only necessary to install additional actuators on the drums of the timers and utilize additional microswitches for the controlled circuits.

It will be understood that various changes may be resorted to without departing from the invention. For example, in certain installations it may be desirable that the master timer 48 provide unequal time sequences of operation of the secondary timers 70 and 76. In such case, it will only be necesary to vary the arcuate extent of the actuators 54 and 56. It is also pointed out that while the invention is particularly well suited for use in the home, it may readily be used for controlling various types of electrical loads in business establishments such as stores and the like.

While the invention has been described herein with considerable particularity, it will be understood that the scope thereof is to be determined by the appended claims.

What is claimed is:

1. Apparatus for automatically controlling the "On-Off" time periods of operation of a plurality of electrical loads comprising an electrically operated rotatable timer device, a plurality of switches associated with said timer, a plurality of actuators carried by said timer and respectively positioned to open and close said switches at periodic intervals, first circuit connections for connecting said switches with said loads to energize and deenergize the loads for time periods determined by the timer, one of said loads comprising a room air-conditioning unit, said first circuit connections including circuit means connecting said unit with a supply source, and said first circuit connections including a relay having normally open contacts positioned in said last name circuit means arranged to be closed upon energization of said relay during closing of one of said actuator controlled switches, and another of said loads comprising an electrically operated water heater unit, said air conditioning unit and said heater unit being controlled by respective thermostats associated therewith, the said first circuit connections including a selectively operable switch movable to one position for connecting said units with said actuator controlled switches and movable to another position to connect said units with a supply source independently of said actuator controlled switches.

2. Apparatus as set forth in claim 1 wherein said rotatable timer device includes a master timer rotatable for one revolution for twenty-four hours, a day timer and a night timer, each of said timers including at least a pair of actuators for respectively controlling a pair of associated switches, first circuit connections including one switch of the pair associated with the master timer for energizing the day timer for a predetermined time period, second circuit connections including the other switch of the last named pair for energizing the night timer for another predetermined time period, the pair of switches associated with the day timer being arranged to periodically control the energization of at least a pair of said loads during the day and the pair of switches associated with the night timer being arranged to periodically control the energization of said pair of loads during the night.

3. Apparatus as set forth in claim 2 which includes a selectively operable master switch movable to one position for connecting said master timer and the switches controlled thereby to a supply source to automatically control the energization of said pair of loads in accordance with the operation of the day and night timers, and movable to a second position to disconnect the last named switches from the source and connect the latter with the pair of loads while maintaining the connection between the master timer and the source.

* * * * *